United States Patent [19]

Souza et al.

[11] 4,143,741

[45] Mar. 13, 1979

[54] PORTABLE ESCAPE LADDER

[75] Inventors: Anthony J. Souza, Lancaster; William E. Askins, Lititz, both of Pa.

[73] Assignee: Woodstream Corporation, Lititz, Pa.

[21] Appl. No.: 865,984

[22] Filed: Dec. 30, 1977

[51] Int. Cl.[2] ..... E06C 1/36; E06C 1/56

[52] U.S. Cl. ..... 182/198; 182/206

[58] Field of Search ..... 182/196, 197, 198, 199, 182/70, 71, 72, 73, 74, 75, 76, 206

[56] References Cited

U.S. PATENT DOCUMENTS

| | | | |
|---|---|---|---|
| 588,389 | 8/1897 | Boemmel | 182/198 |
| 1,098,391 | 6/1914 | McArthur | 182/199 |
| 1,994,408 | 3/1935 | Pierre | 182/73 |
| 2,304,955 | 12/1942 | Pierre | 182/198 |
| 3,727,724 | 4/1973 | Gilbert | 182/198 |
| 3,834,492 | 9/1974 | Ronk | 182/196 |

FOREIGN PATENT DOCUMENTS

| | | | |
|---|---|---|---|
| 490129 | 2/1953 | Canada | 182/198 |

*Primary Examiner*—Reinaldo P. Machado
*Attorney, Agent, or Firm*—Holman & Stern

[57] ABSTRACT

A portable escape ladder comprises a bracket for gripping over a building window ledge, a pair of chains suspended from the bracket and supporting a series of spaced transverse rungs therebetween and optional stand-off devices attached at least to some of the rungs to hold the ladder a fixed distance from the building wall. There is provided a form of connection between the rungs and the chains in which the ends of the rungs are pressed flat and formed with an opening in which the junction of a pair of chain links is captively held. The optional stand-off devices comprise substantially flat frames with upright extensions fitting in bores formed in the respective rungs and fastened in place by snap nuts on the ends of the uprights.

8 Claims, 4 Drawing Figures

PORTABLE ESCAPE LADDER

BACKGROUND OF THE INVENTION

This invention relates to portable escape ladders, primarily for use as fire escape ladders, of the type which can be readily slung out from a building window and attached to the window ledge, or the like, to depend therefrom in the case of a fire or other emergency. Such ladders are well known and generally comprise a suspension bracket which grips over a window ledge, a pair of chains or like flexible suspension members attached each at one end to the bracket, a series of spaced, transverse ladder rungs slung between the chains and some form of stand-off means, if required, for holding the rungs a fixed distance from an outer wall surface when the ladder is in use.

One particular form of prior art ladder of the above type is shown in U.S. Pat. No. 3,834,492 to HUGO V. RONK and employs suspension chains depending from a window ledge-engaging bracket and tubular metal rungs slung between the chains. Connections between the suspension chains and the individual rungs are formed by flattening the ends of the rungs which are then notched and bent perpendicularly to the rung axis to form a hook-like member. The hook-like member is engaged in a chain link and then bent back against the rung about a line perpendicular to the longitudinal rung axis to trap the chain link in the notched section. Loads imposed on the rung in use, thereby act through the notched section of the flattened end which is of reduced cross-section and which has been subject to bending and thereby weakened.

It is an object of the present invention to provide a ladder of the above type which is simple and economical to manufacture while being strong and reliable in use.

More specifically it is an object of the invention, in a ladder of the above type, to provide a novel form of connection between each ladder rung and the suspension chains, which connections can be simply produced by conventional cold-forming processes performed on the rungs themselves, which connections includes no components additional to the rungs and chains and which connections are not subject to weaknesses imposed by cold working during the production of the connections.

It is a further object of the invention to provide for an escape ladder of the above type, a form of stand-off device which can readily and simply be attached to selected ladder rungs.

BRIEF SUMMARY OF THE INVENTION

In accordance with one aspect of the present invention, the rungs for an escape ladder of the type described are each formed from a length of metal tubing. The opposite end portions of each rung are flattened into a common plane in a pressing or like operation and a hole is formed through each flattened portion with a slit leading from said hole to a free transverse edge of the rung. Sections of metal on opposite sides of the slits are bent out of the plane of said flattened portion to increase the width of the slits and in each case allow the junction between a pair of adjacent links of one of the ladder suspensin chains to be passed into said opening through the slit with the respective links of said pair embracing sections of the flattened portion of the rung on opposite sides of the slit. To complete the connection, the bent sections of metal on opposite sides of the slit are then bent back into the plane of the flattened portion to decrease the width of the slit so that the chain cannot be removed and said junction is effectively trapped in said opening.

In accordance with a further feature of the invention, a stand-off device for attachment to a ladder rung is formed from a metal rod, bent to form a substantially planar open frame with opposite ends of the rod being bent up at right angles to the plane of the frame to form extension pieces which in use fit through aligned bores drilled through the rung. Fasteners such as snap nuts are fitted to free ends of the extension pieces projecting from said bores to attach the frame to the rung.

BRIEF SUMMARY OF THE DRAWINGS

The invention is illustrated by way of example in the attached drawings, in which.

DESCRIPTION OF THE PREFERRED EMBODIMENT

Figure 1:
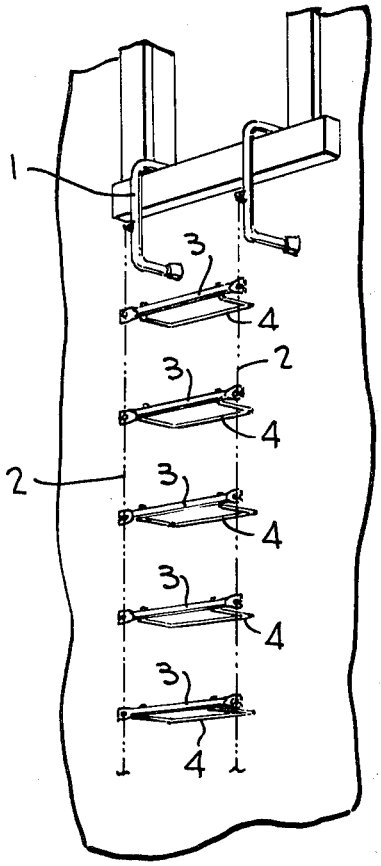
FIG. 1 is a perspective view of a fire escape ladder suspended from a window ledge.

As illustrated in FIG. 1, a portable fire escape ladder comprises a suspension bracket 1 of any known type which grips over a window ledge and which has a pair of chains 2 suspended therefrom with spaced transverse rungs 3 slung between respective chains. Each rung 3 is shown having a stand-off device 4 attached thereto for holding the rung a fixed distance from the building wall but it is not essential that such stand-off device be attached to every rung of the ladder and in practice it is possible to use the stand-off devices only in association with selected rungs. In fact, for the broader aspects of this invention, no stand-off devices need be utilized or one or more stand-off devices of prior art construction rather than the preferred device shown herein may be included.

Figure 3:
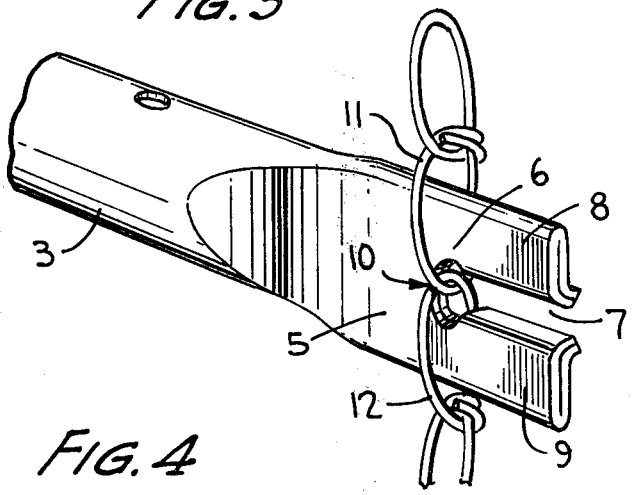
FIG. 3 is a perspective view of a part of a ladder rung showing the rung in course of attachment to a suspension chain.

Each ladder rung 3 (FIGS. 3 and 4) is made from a metal tube having its ends pressed close to provide coplanar flattened portions 5. A hole 6 and slit 7 are stamped or otherwise formed in each flattened portion, with the slit 7 leading from the hole to the transverse free edge of the tube and with sections of metal on either side of the slit being bent back out of the plane of the flattened portion 5 as shown in FIG. 3. The stamping out of the hole 6 and slit 7 and bending back of the metal sections on either side of the slit may be carried out in common or separate stamping or like operations and are effective to provide the flattened portion 5 with a bifurcated section comprising limbs 8 and 9 defining the hole 6 and slit 7 therebetween, with the inner margins of said limbs being the sections which are bent back in FIG. 3. In this condition, a junction 10 between a pair of adjacent links 11 and 12 of one of the chains 2 can be slid into the hole 6 through the slit 7 with the loops of the respective links 11 and 12 embracing the limbs 8 and 9, respectively.

Figure 4:
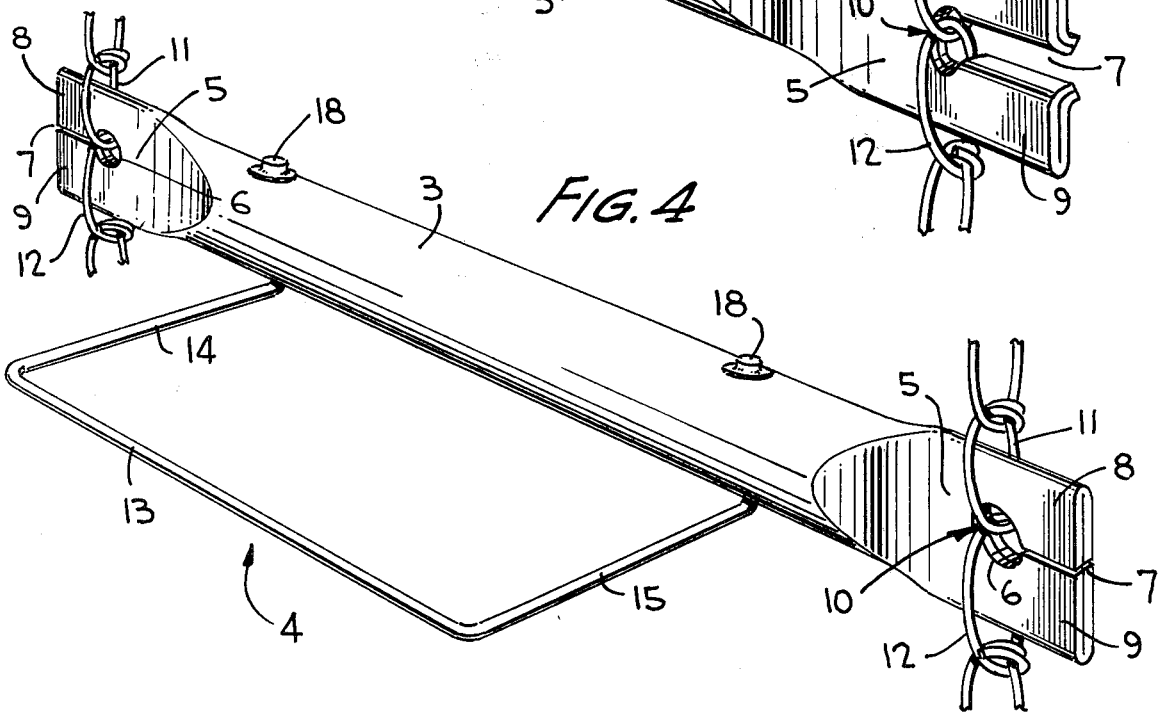
FIG. 4 is a perspective view of a complete rung and stand-off assembly attached to the ladder suspension chains.

Then, as shown in FIG. 4, the bent back inner sections of limbs 8 and 9 are in each case pressed back into the plane of the flattened portion 5 effectively to close the slit 7 and trap the link junction 10 in the hole 6 with the links 11 and 12 embracing limbs 8 and 9. Thus an effective and secure connection is formed between the rung and chain without the use of other fastening members. Further, the connection has a high bending and shear resistance and loads imposed on a rung in use do not act through a section of the flattened portion which has been subject to bending stresses.

Figure 2:
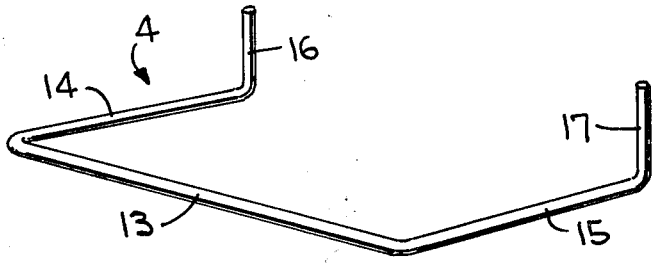
FIG. 2 is a perspective view of a stand-off device for use in a ladder as shown in FIG. 1.

FIG. 2 shows a preferred form of stand-off device in the form of a metal rod bent to provide a central section 13, a pair of end sections 14, 15 coplanar with and extending from the central section and defining therewith a flat open rectangular frame and a pair of upright extension pieces 16, 17 bent at right angles to the rectangular frame at opposite end of the rod. As shown in FIG. 4, the extension pieces fit in aligned holes formed in a tubular rung 3 and their projecting ends are provided with fasteners 18 preferably in the form of snap nuts which thereby attach the stand-off to the rung. The aligned holes in the rung are orientated such that the rectangular frame extends away from the rung in a plane perpendicular to the flattened portions 5. By utilizing a bent rod and snap nuts in the manner indicated, a particularly simple and effective form of stand-off is thereby provided, and the vertical extension pieces fitting through aligned bores in the rungs and held by snap nuts or like fasteners provides an effective and simple manner of attaching a stand-off to a ladder rung. The rectangular shape and generally horizontal orientation of the stand-off devices as herein described are not essential features of the invention and modifications may be made to the shape of the stand-off and its alignment relative to the horizontal. Further, the stand-off devices can be substantially planar without bent up sections, in which case the opposed ends of a say rectangular shaped stand-off, fit in substantially horizontally disposed bores in a rung with fasteners of the type described being used to attach the stand-off to a rung. However, the construction shown provides the optimum arrangement in allowing extended contact by the flat edge 13 with a wall or the like and sturdy support via the perpendicular extensions 16, 17.

While the present invention has been described with reference to a particular embodiment thereof, it will be understood that numerous modifications can be made by those skilled in the art without departing from the scope of the invention. Accordingly, all modifications and equivalents may be resorted to which fall within the scope of the invention as defined in the appended claims.

What is claimed is:

1. A rung for a portable escape ladder, said rung comprising an elongate member having substantially coplanar flattened end portions, each end portion including a bifurcated section comprising a pair of limis extending substantially in the longitudinal direction of said elongate member and having free ends defining a transverse edge of said elongate member, said limbs defining therebetween an opening through said flattened portion and a slit leading from said opening to said edge, said limbs being deformable in regions adjacent said slit to alter the effective width of said slit whereby a junction of a pair of interconnected chain links can be passed along said slit from said edge into said opening with the respective links of said pair embracing respective ones of said limbs and whereby said junction can then be captively held in said opening by deforming said limbs suitably to reduce the width of said slit to prevent passage therealong of said junction.

2. The rung as defined in claim 1 in combination with a stand-off device for holding said rung a fixed distance from a vertical surface when said rung is in use in an escape ladder and fastening means attaching said stand-off device to said rung, said rung including spaced aligned bores formed therethrough, said stand-off device including a pair of elongate members receivable in said bores with end sections of said elongate members projecting from said bores and frame means extending from said elongate members away from said rung, said fastening means comprising fasteners attached to said projecting end sections of said elongate members.

3. The combination of claim 2 wherein said frame means is a one-piece open frame, said elongate members comprising extensions of said one-piece frame.

4. The combination of claim 3, wherein said extensions are disposed in a plane substantially perpendicular to said frame.

5. In a portable escape ladder comprising a suspension bracket means, a pair of suspension chains, each chain having one end attached to the bracket means, a plurality of ladder rungs, connection means at each end of each rung connecting the rungs to the chains, the rungs being disposed in spaced parallel relation along the length of the chains with each rung extending transversely between the chains, the improvement wherein each said rung comprises a tubular member and each said connection means comprises a flattened end portion on said tubular member, said flattened portion having a bifurcated section comprising a pair of limbs extending generally in the longitudinal direction of said tubular member and having free ends defining a transverse edge of said tubular member, said limbs defining therebetween an opening through said flattened portion and a slit leading from said opening to said free edge and wherein a junction between a pair of links of one of said chains is held captively in said opening with the respective links of said pair embracing the respective limbs of said bifurcated section and the width of said slit being insufficient to permit removal of said junction from said opening.

6. The improvement as defined in claim 5 further including stand-off means for holding at least some of said rungs away from a vertical wall or the like when the ladder is suspended by the bracket means, said stand-off means comprising stand-off devices attached to selected ones of said rungs each stand-off device comprising a planar open rectangular frame extending away from a rung in a plane perpendicular to the plane containing said flattened portions of said rung and means attaching said frame to said rung.

7. The improvement as claimed in claim 5 further including stand-off means for holding at least some of said rungs away from a vertical wall or the like when the ladder is suspended by the bracket means, said stand-off means comprising stand-off devices attached to selected ones of said rungs, said selected ones of said rungs having a pair of aligned bores formed therethrough between said flattened end portions, said stand-off devices each comprising a pair of elongate members receivable in said pair of bores of a rung with ends of said elongate members projecting from said bores, and frame means extending from said elongate members away from said rung, and wherein fastening means is provided for attaching said stand-off devices to said selected rungs, said fastening means comprising individual fasteners receivable on the projecting ends of said elongate members.

8. The improvement of claim 7 wherein said elongate members are in a plane substantially perpendicular to said frame means.

* * * * *